United States Patent [19]

Morin et al.

[11] Patent Number: 4,552,078

[45] Date of Patent: Nov. 12, 1985

[54] PROCESS AND INSTALLATION FOR RECYCLING SOLID UNBURNT MATERIALS IN A FLUIDIZED BED

[75] Inventors: Jean-Xavier Morin, Le Creusot; Gérard Chrysostome, Montchanin, both of France

[73] Assignee: Creusot-Loire, Paris, France

[21] Appl. No.: 556,870

[22] Filed: Dec. 1, 1983

[30] Foreign Application Priority Data

Dec. 8, 1982 [FR] France ..... 82 20546

[51] Int. Cl.[4] ..... F23D 1/00

[52] U.S. Cl. ..... 110/347; 110/101 CA; 110/103; 110/186; 110/263; 122/4 D

[58] Field of Search ..... 122/40; 431/7, 170; 110/245, 263, 347, 101 CA, 103; 165/104.16

[56] References Cited

U.S. PATENT DOCUMENTS

| | | | |
|---|---|---|---|
| 3,902,462 | 9/1975 | Bryers | 122/4 D |
| 4,084,545 | 4/1978 | Nack et al. | 122/4 D |
| 4,103,646 | 8/1978 | Yerushalmi et al. | 122/4 D |
| 4,312,301 | 1/1982 | Anson | 122/4 D |
| 4,338,074 | 7/1982 | Johansson | 431/7 |

FOREIGN PATENT DOCUMENTS

| | | | |
|---|---|---|---|
| 68708 | 6/1981 | Japan | 431/7 |

*Primary Examiner*—Albert J. Makay
*Assistant Examiner*—Steven E. Warner
*Attorney, Agent, or Firm*—Pollock, Vande Sande & Priddy

[57] ABSTRACT

Process and apparatus for supplying combustible material to a fluidized bed in a vessel connected to a separating device for the solid particles entrained with the smoke and containing a certain proportion of unburnt matter, the particles recovered being recycled into the fluidized bed. During a normal operation of the fluidized bed supplied with combustible matter, the solid particles recovered in the separating device are accumulated in a silo and periodically, the supply of combustible matter is stopped and the particles accumulated in the silo are recycled into the fluidized bed with a regulated flow rate, so that the combustion of the unburnt matter contained in the recycled particles maintains the temperature of the fluidized bed at the desired level. The exothermic reaction is maintained alternately by the combustion of the combustible matter in the normal operating phase and by the combustion of the unburnt matter in the recycling phase. The invention is specially useful in boilers supplied with powdered coal.

7 Claims, 3 Drawing Figures

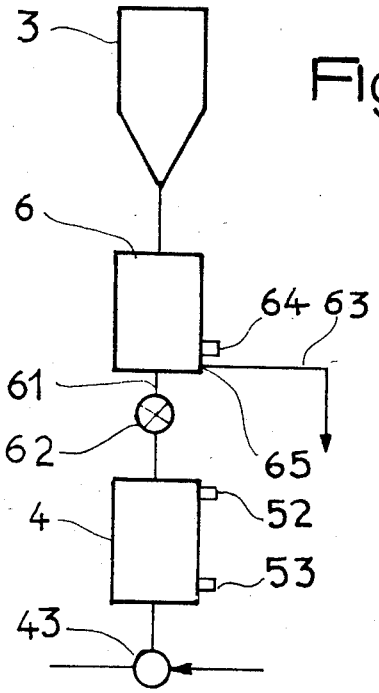
Fig 2
Fig 3
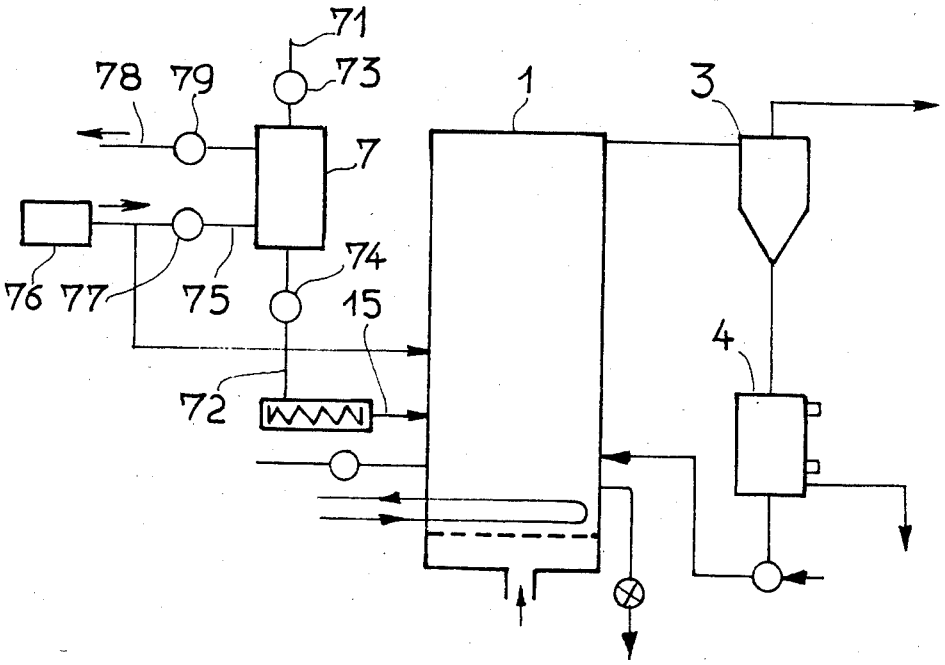

PROCESS AND INSTALLATION FOR RECYCLING SOLID UNBURNT MATERIALS IN A FLUIDIZED BED

FIELD OF THE INVENTION

The invention relates to a process and apparatus for supplying combustible material for an exothermic reaction carried out in a fluidized bed.

Installations, for example, boilers, effecting the combustion in a fluidized bed of coal or more generally of solid hydrocarbon fuels in the system called dry chamber, i.e., unmelted or unagglomerated, produce ashes which are removed by purging, but also fine solid particles drawn up by the smoke and which, in a sometimes considerable proportion, are incompletely burnt. The result is a degradation of the combustion efficiency, and the unburnt fines can in fact represent 5 to 20% of the fuel introduced into the boiler. For this reason, the vessel in which the fluidized bed is produced is normally connected at its upper part by a smoke discharge duct to a separating device for the solid particles drawn up with the smoke, and this may be a simple mechanical device of the cyclone type. Until now, the solid particles recovered at the base of the cyclone were recycled continuously either into the fluidized bed of the boiler or into an appended fluidized bed so as to attempt to burn them and hence to improve combustion efficiency.

However, the fine dusts collected by the cyclone contain not only the unburnt particles but also contain a certain proportion of fine ashes which are also drawn up by the smoke. In addition, when sorbant such as limestone or dolomite is used to desulfurize the fuel in the course of combustion, such sorbant also contains, or indeed produces by attrition, fine particles which are also drawn up with the smoke. For this reason, the proportion of non-combustible elements collected at the cyclone can range from 20 to 70%, for example.

The recycling of such a product of which only a fraction is combustible produces a gradual enrichment in incombustible elements of the dust collected at the cyclone. In addition, the amount of dust in suspension in the smoke increases, which prohibits normally recycling the whole of the dust collected at the cyclone and makes it obligatory to proceed with a continuous purge of a fraction of this dust. The combustible portion contained in the purge is hence lost.

BACKGROUND OF THE INVENTION

To avoid this drawback, it is sometimes preferred to recycle the fines recovered at the cyclone not into the fluidized bed of the boiler but into an accompanying fluidizing bed. This addition of a complementary piece of equipment however has the disadvantage of complicating the installation and of increasing its cost.

SUMMARY OF THE INVENTION

It is an object of the invention to provide an improved process and installation obviating the addition of complementary equipment and enabling recycling of the unburnt material into the fluidized bed without having the disadvantages of prior art installations.

According to the invention, during the normal functioning of the fluidized bed fed with combustible material, the particles recovered in the separating device are accumulated in a silo and, periodically, the feeding with combustible materials is stopped and bed are recycled the particles accumulated in the silo are recycled into the fluidized bed with a flow rate adjusted so that the combustion of the unburnt materials contained in the recycled particles keeps the temperature of the fluidized bed at the desired level, the exothermic reaction being thus sustained alternately by the combustion of the combustible material in normal operation and by the combustion of the unburnt materials in the recycling period.

In a first embodiment, the solid particles drawn up with the smoke during the recycling phase and separated from the latter accumulate in the silo and are recycled again in the fluidized bed, the recycling thus proceeding as long as the content of unburnt material of the solid particles enables the temperature of the fluidized bed to be maintained.

The stopping of the recycling phase of the solid particles and the return to normal operation are actuated either as soon as the temperature of the fluidized bed falls below a fixed limit, or when the flow rate of recycling of the unburnt materials necessary for the maintenance of the temperature of the fluidized bed exceeds a fixed limit.

In another embodiment, the solid particles drawn up with the smoke in the recycling phase are, after separation, accumulated in an intermediate silo interposed between the separating device and the recycling reserve silo.

In a particular application, the invention also enables improvement of the method of supplying the fluidized bed with combustible material. In fact, when the latter operates under pressure, as is generally the case, the solid combustible materials must be introduced by means of a lock device which, for continuous supply, must comprise two chambers under pressure supplied alternately through an orienting valve. Thus, when one of the chambers is filled with combustible material, its supply is closed and it is placed at the pressure existing in the combustion chamber so as to be able to supply the latter without a pressure drop. During this time, the second chamber is isolated from the combustion chamber, placed at atmospheric pressure and supplied with combustible matter through the orienting valve. When the first chamber is almost empty, the circuits are reversed, the second chamber being isolated, placed under pressure and then connected to the combustion chamber for the supply of the latter with combustible matter, while the first chamber is isolated from the combustion chamber and placed at atmospheric pressure so as to be again fillable through the orienting valve.

The improved recycling process according to the invention enables this arrangement to be simplified.

In fact, by means of the invention, the supply proceeds from a single chamber forming a lock which, alternately, is placed at the pressure of the combustion vessel for supplying the latter during the normal operating phase, and then isolated from the combustion vessel during the recycling phase to be placed at atmospheric pressure and filled again with fuel material.

BRIEF DESCRIPTION OF THE DRAWINGS

The invention will be better understood from the detailed description which follows of several embodiments illustrated in the accompanying drawings.

In the drawings:

FIG. 2 is a diagram of a modification.

FIG. 3 shows diagrammatically a particular method of supplying fuel materials.

DETAILED DESCRIPTION

Figure 1:
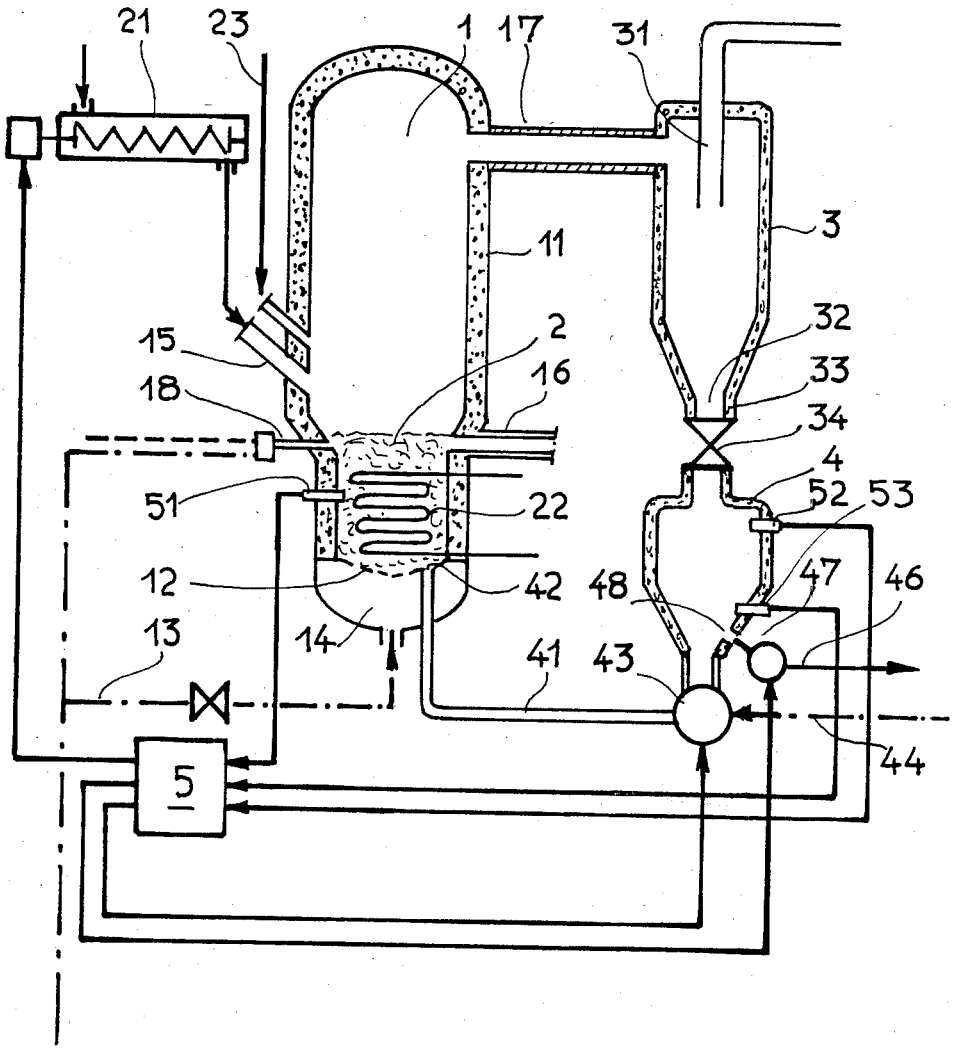
FIG. 1 shows diagrammatically a boiler operating with a fluidized bed and the improved recycling installation according to the invention.

FIG. 1 shows by way of example a coal boiler operating as a fluidized bed and enabling desulfurization in the course of combustion. The installation comprises a vessel 1 bounded by a jacket 11 of refractory material closed at its upper part and provided at its base with a fluidizing grid 12 which supports a fluidized bed 2 and permits the distribution of fluidizing and combustion air introduced through a circuit 13 into a plenum 14 placed beneath the fluidizing grid 12.

Above the fluidized bed 2 opens an inlet 15 through which the fuel material is introduced fed, for example, through a device 21 of known type. The limestone enabling desulfuration can be introduced with the combustible matter or indeed through a special supply circuit 23 which has not been shown in detail in the figure.

The sorbant of limestone charged with sulfur and the ashes from the coal are extracted through an outlet 16.

In the case shown in the figure, where the installation is a boiler, exchangers 22 placed in the fluidized bed and supplied with water enable the production of steam.

At the upper part of the vessel 1 opens an exhaust pipe 17 for the combustion smoke charged with solid particles in the form of fine dust constituted, in varying proportions, by fine ash from the coal, fine unburnt particles and fine particles of sorbant. The smoke extracted through the pipe 17 passes into a separating device constituted, for example, by a cyclone 3 which comprises an upper gas outlet 31 and a lower outlet 32 for the separated solid particles.

The dust-freed smoke removed through the outlet 31 is directed to a downstream processing installation (not shown) which can include a heat recovery system and a final dust removal, before rejection to atmosphere.

The outlet 32 from the cyclone 3 iss connected by a pipe 33 provided with a valve 34 to a vessel forming a silo 4 in which the particles collected by the cyclone 3 accumulate when the valve 34 is opened.

Silo 4 is connected to the combustion vessel 1 through a recycling circuit comprising a pipe 41 opening at 42 at the base of the fluidized bed and provided at its origin with a valve 43 enabling the flow rate of particles recycled through the pipe 41 to be regulated. In the example shown, the reinjection of the particles is effected by gas such as air or an inert gas introduced through a pipe 44 opening into the valve 43 and which produce fluidization of the particles in the pipe 41 so as to convey them up to the fluidized bed, the reinjection flow rate being determinable, for example, by the flow rate of gas injected through the pipe 44 and regulated by the valve 43. To this effect, the reinjection flow rate can be servo-coupled to the temperature of the fluidizing bed through a regulating circuit comprising a control unit 5 which receives data corresponding to the temperature level in the fluidized bed, supplied by a detector 51 which emits a regulating order for the valve 43.

On the other hand, the silo 4 is provided with an exhaust pipe 46 preceded by a valve 47 which can be actuated by the regulation circuit 5, the end of evacuation being governed by a control member of the low level 53 placed at the base of the silo 4, above the exhaust orifice 48. By means of the features which have just been described, the combustion vessel 1 can be supplied in successive periods alternately with combustible matter in a phase of normal operation and with solid unburnt materials in a recycling phase with the particles accumulated in the silo.

At the start of the operating cycle, the silo 4 is empty. The fluidized bed 2 is supplied normally with combustible matter through the inlet 15, with a flow rate regulatable to obtain the desired temperature in the fluidized bed, the latter being ignited by a burner 18. During this phase, the flow rate of coal supplied by the device 21 can be servo-coupled to the temperature of the fluidized bed by the regulating circuit 5. The flow rate of limestone injected can itself be servo-coupled to the flow rate of coal so as to maintain desulfurization at its optimum.

The valve 43 being closed and the valve 34 open, the fine particles of unburnt ashes and of sorbant drawn up with the smoke into the pipe 17 and separated in the cyclone 3 accumulate in the silo 4. The coarse particles of coal ash and sorbant charged with sulfur are eliminated through the outlet 16 by suitable means.

When the silo 4 contains a sufficient amount of dust, as determined by a high level control member 52 placed at the upper part, the control unit 5 causes stoppage of the device 21 for the supply of combustible material and the opening of the valve 43 enabling the recycling of the solid particles and then the resulation of the latter to maintain the temperature of the fluidized bed. The air flow rate introduced through the circuit 13 normally remains constant.

The particles accumulated previously in the silo 4 are thus re-introduced into the fluidized bed with a flow rate servo-coupled to the temperature of the latter, the injection of the fine particles being carried out in the lowest layers of the fluidized bed through the orifice 42. The flow rate of sorbant introduced through the circuit 23 can be maintained constant and equal to that of the first normal operating phase or, as a function of the composition of the recycled particles, can be cancelled, modified or maintained equal to a new value. It is possible to envisage, for example, servo-coupling it in one way or another to the flow rate of the particles recycled through the pipe 41.

When the flow rate of sorbant supplied at 23 is stopped, the evacuation of the coarse particles through outlet 16 is also stopped. In the other cases, the flow rate of the outlet 16 is modified to suit the circumstances. In particular, in the case where the flow rate from the outlet 16 is slaved to the level of the fluidized bed, there is no particular regulation to provide for the outlet flow rate of the coarse particles other than that normally provided.

In the course of this second phase of recycling the solid particles contained in the silo 4, at least a fraction of the unburnt solids contained in the particles is burnt. The fraction which remains unburnt following this recycling is drawn with the non-combustible dust and the smoke and discharged through the duct 17 toward separating device 3 whose outlet 34 is open so that the particles are collected again by the silo 4 in the course of emptying, to be again reinjected into the fluidized bed.

Normally, the flow rate of the particles reentering the silo 4 during the recycling phase is less than the flow rate of the particles recycled, since a part of the latter has burnt, but the capacity of the silo 4 can be selected so as to support the fluctuations in levels.

It can be seen that the installation permits operation in closed circuit, the unburnt particles passing several times into the silo 4 and then into the fluidized bed until complete combustion. Of course, the proportion of unburnt matter contained in the recycled particles diminishes and the recycling flow rate must hence increase in order that the temperature measured by the detector 51 may remain constant. This is why, in the embodiment illustrated, the control unit 5 which receives the data relating to the temperature level in the fluidized bed can actuate the closing of the valve 43 and the placing of the supply device 21 in action so as to determine the stopping of the recycling phase and the resumption of the normal operating phase when the temperature level measured by the detector 51 drops beneath a predetermined limit.

In another embodiment, the flow rate of the recycled particles may be measured permanently so as to provide to the control unit data which determines the stopping of the recycling and the resumption of normal operation when the recycling flow rate exceeds a selected limit.

At the end of the recycling phase, therefore, the closing of the valve 43 and the evacuation of the particles accumulated at this moment in the silo 4 are actuated by opening the valve 47 of the exhaust pipe 46. At the moment when the level of particles reaches the height of the lower level control member 53 placed at the base of the silo 4, the evacuation valve 47 is closed and the supply of the fluidized bed is resumed through the inlet 15 by placing the supply device 21 back in operation; the first phase of normal operation is then again arrived at.

Of course, the evacuation of the silo 4 through the pipe 46 must be fairly rapid so that the temperature of the fluidized bed does not drop too much before return to the first phase of normal operation. Experience has shown that, taking into account the inertia of the fluidized bed, the temperature of the latter varies fairly little during the time required for evacuation.

However, as indicated above, it is also possible not to wait for the temperature of the fluidized bed to drop beneath the selected limit by actuating the stopping of recycling and return to normal operation as soon as the flow rate of particles recycled through the circuit 41 exceeds a certain reference value; it is then easier to limit the temperature drop of the fluidized bed during evacuation of the silo 4 and before the return to the first phase.

However, in another modification, it is also possible to avoid any temperature drop of the fluidized bed by initiating the return to normal operation simultaneously with evacuation of the silo, i.e., from the cessation of the recycling phase.

In this case, the particles produced by the combustion of the combustible material, and therefore containing a certain amount of unburnt matter, accumulate in the silo 4 above the sterile particles before the latter have been completely evacuated.

To avoid removal by the exhaust pipe 46 of particles containing a notable fraction of unburnt matter, the level control 53 is then arranged at a sufficient height so that the volume comprised between the level of the exhaust orifice 48 opening into the pipe 46 and that of the control member 53 is greater than the volume of particles generated by the combustion of the coal during the evacuation time through the pipe 46.

In certain cases, it is possible to ensure fairly complete combustion of the unburnt material in a single passage in the fluidized bed 2. It is then advantageous to use the arrangement illustrated in FIG. 2 in which the installaion is supplemented by a capacity 6 interposed between the lower outlet from the cyclone 3 and the silo 4 and connected to the latter through a pipe 61 provided with a valve 62.

During the first phase of normal operation, the valve 62 is opened and the valve 43 placed at the outlet of the silo 4 is closed. The particles generated by combustion in the fluidized bed pass through the capacity 6 and accumulate in the silo 4.

When passing into the recycling phase, the valve 43 is opened but the valve 62 is closed. The fine dusts generated by the combustion of the recycled unburnt matter coming from the silo 4 and which themselves contain a low proportion of unburnt matter accumulate in the capacity 6 which thus constitutes an intermediate silo inserted between the cyclone 3 and the silo 4.

In this case, the proportion of unburnt matter contained in the recycled particles is substantially constant and there is normally little variation in the temperature of the fluidized bed and the recycling flow rate. The latter is hence continued until the silo 4 is evacuated, i.e., when the level of the particles has reached the level fixed, for example, by the control member 53. The valve 43 is then closed and immediately the rapid evacuation of the intermediate silo 6 through an emptying pipe 63 is actuated immediately, such evacuated being stopped when the level of particles reaches the height of a control member 64 placed at the base of the silo 6.

At this moment, the valve 62 is opened and the first phase of normal operation is resumed by actuating the supply of the fluidized bed with the combustible material through the device 21.

In this arrangement, according to a modification, it is possible to trigger the return to the phase of normal combustion from the end of the recycling phase, i.e., at the moment when evacuation of the silo 6 through the exhaust pipe 63 is actuated. In this way any temperature drop of the fluidized bed is avoided, but it is necessary to leave in the silo 6 a sufficient capacity between the safety level determined by the control member 64 and the level of the orifice 65 of the exhaust pipe 63, this capacity being greater than the volume of particles generated by the combustion of the coal during evacuation of the silo 6. In this way the withdrawal through the orifice 65 of the particles containing unburnt matter is avoided.

As soon as the level 64 is reached, evacuation through the pipe 63 is stopped and the valve 62 is opened, all the particles contained in the silo 6 beneath the level 64 then flowing into the recycling silo 4. The normal combustion phase then continues, as previously, until the upper level 52 of the silo 4 is reached.

By way of example, for a duration of the normal combustion phase of the order of one hour, the duration of the second recycling phase will be of the order of ten minutes, the rapid emptying having to be done in 1 minute. However, by increasing the volumes of the recycling silo 4 and of the intermediate silo 6, it has been possible to continue the normal phase for 22 hours, the recycling phase then being two hours and evacuation being feasible in one minute by suitable means. It is then possible to limit the disadvantages associated with the possibility of a temperature drop before the return to normal combustion.

As has been indicated above, the invention enables simplification of the supply of the fluidized bed when the latter must operate under pressure.

Such an installation is shown in FIG. 3.

The unit constituted by the combustion vessel 1, the separating device 3 and the recycling silo 4 can operate according to one of the modifications which has just been described, the vessel 1 being then maintained under pressure by suitable means. It is therefore necessary for the combustible material to be placed at the pressure existing in the vessel 1 before being introduced into the latter. This is why there is conventionally used a lock system constituted by a chamber 7 interposed in the supply circuit upstream of the supply device 21 and the inlet 15 for the combustible matter into the vessel 1. The chamber 7 can be isolated by inlet 73 and outlet 74 valves placed respectively in the supply circuit 71 of combustible material and the pipe 72 which connects it to the supply device 21 and to the inlet 15 of the vessel 1.

On the other hand, the chamber 7 can be placed at the same pressure as the vessel 1 through a pressurizing circuit 75 which connects it to a gas reserve 76 and in which is placed a valve 77, or at atmospheric pressure through a depressurizing circuit 78 provided with a valve 79.

At the start of the operation, the chamber 7 is filled with coal through the supply circuit 71, the valves 74 and 77 being closed. When the chamber 7 is full, the valves 73 and 79 are closed and the valve 77 opened to place the chamber 7 at the desired pressure, i.e., that which, at this moment, exists in the vessel 1. It is then possible to open the valve 74 and supply the vessel 1 with combustible material through the pipe 72 connected to the supply device 21 of which the flow rate is regulated, so as to cause the fluidized bed to operate in normal operation at the desired temperature.

As has previously been described, the solid particles entrained with the smoke accumulate in the silo 4 until the recycling phase is initiated. At that moment, the supply device 21 is stopped and the outlet valve 74 from the chamber 7 is closed.

The latter being isolated from the vessel 1, which is then supplied with recycled unburnt matter, it is possible to close the valve 77 and to open the valve 79 of the depressurization circuit 78.

When the chamber 7 is at atmospheric pressure, the valve 73 is opened and the supply device 21 actuated for the filling of the chamber 7 with combustible matter. Of course, the filling must be completed in a time less than the duration of the recycling phase, but it is not difficult to meet this requirement by using suitable means and by selecting as desired the relative volumes of the recycling silo 4 and of the supply chamber 7. When the latter is full, the valves 73 and 79 are closed and the valve 77 opened to place the chamber 7 at the pressure of the combustion vessel 1. The installation is then ready for return to the normal combustion phase, since it suffices to open the valve 74 and to supply the fluidized bed at the desired moment after the stopping of the recycling and the emptying of the silo 4.

Of course, the volume of the silo 4 must be selected as a function of that of the chamber 7 so as to contain all the solid particles generated by the combustion of the coal contained in the chamber 7 during the normal combustion phase.

Thus, the invention makes it possible to supply the combustion vessel 1 with combustible matter occurring at the desired pressure and by using a single lock. Of course, it is possible to use a similar device and the same sequence of operation to supply the combustion vessel with limestone or dolomite through the circuit 23. But it is possible also, as is done in certain cases to mix the coal and the dolomite upstream of the supply circuit 71 so as to use a single lock fed with the prepared mixture.

We claim:

1. Process for supplying with combustible material a fluidized bed combustion installation comprising a vessel (1) having therein a fluidized bed for the combustion of a combustible material producing smoke, conduit means (17) for evacuating said smoke carrying along solid particles containing unburned matter, a device (3) for separating out said solid particles carried along by said smoke, and a circuit (41) for recycling to said fluidized bed said solid particles recovered in said separating device, said process comprising two alternating phases for supplying said fluidized bed with combustible material, viz., (1) a first phase of normal operation in which said fluidized bed is supplied with combustible material at an adjustable flow rate by supply means (21) so as to produce a predetermined temperature in said fluidized bed, and during which said solid particles recovered in said separating device (3) are accumulated in a reverse silo (4), said recycling circuit being closed, and (2) a second periodic recycling phase during which supply from said supply means (21) is halted and said recycling circuit (41) is opened, in order to recycle to said fluidized bed said solid particles accumulated in said reserve silo (4) during said first phase, recycling being so regulated that the combustion of said unburnt matter contained in said solid particles maintains the temperature of said fluidized bed at a desired level, said recycling circuit (41) being closed as soon as said temperature can no longer be maintained at said level, the accumulated particles being removed during a period sufficiently small not to cause a drop in temperature of said fluidized bed below a predetermined limit, whereupon normal first phase operation resumes;

(3) an exothermic reaction being maintained alternatively by combustion of said combustible material in said first phase and by combustion of said unburnt matter in said second phase.

2. Process according to claim 1, wherein said solid particles entrained said smoke during said second phase are accumulated in an intermediate silo interposed between said separating device and said reserve silo.

3. Process according to claim 1, wherein the temperature of said fluidized bed is measured permanently and recycling of said solid particles is servo-coupled to the temperature of said fluidized bed so as to maintain said temperature at the same level as during said first phase.

4. Process according to claim 3, wherein detection of a drop in temperature below said desired level determines the stopping of said second phase and resumption of said first phase.

5. Process according to claim 4, wherein the flow rate of recycling said solid particles is measured continuously, said second phase being terminated and return to said first phase being actuated when said flow rate necessary for the maintainence of said desired temperature level exceeds a predetermined limit.

6. Process for supplying with combustible material a fluidized bed combustion installation comprising a vessel (1) having therein a fluidized bed for the combustion of a combustible material producing smoke, conduit means (17) for evacuating said smoke carrying along solid particles containing unburned matter, a device (3) for separating out said solid particles carried along by said smoke, and a circuit (41) for recycling to said fluidized bed said solid particles recovered in said separating device, said process comprising two alternating phase for supplying said fluidized bed with combustible material, viz., (1) a first phase of normal operation in which said fluidized bed is supplied with combustible material at an adjustable flow rate by supply means (21) so as to produce a predetermined temperature in said fluidized bed, and during which said solid particles recovered in said separating device (3) are accumulated in a reserve silo (4), said recycling circuit being closed, and (2) a second periodic recycling phase during which supply from said supply means (21) is halted and said recycling circuit (41) is opened, in order to recycle to said fluidized bed said solid particles accumulated in said reserve silo (4) during said first phase, recycling being so regulated that the combustion of said unburnt matter contained in said solid particles maintains the temperature of said fluidized bed at a desired level, said recycling circuit (41) being closed as soon as said temperature can no longer be maintained at said level, the return to normal supply of said fluidized bed with combustible matter and the rapid removal of accumulated particles being actuated simultaneously at the end of said second phase, said rapid removal being stopped before the complete emptying of said silo when the level of the particles in the latter reaches a predetermined limit, whereupon normal first phase operation resumes;

(3) an exothermic reaction being maintained alternatively by combustion of said combustible material in said first phase and by combustion of said unburnt matter in said second phase.

7. Process for supplying with combustible material a fluidized bed combustion installation comprising a vessel (1) having therein a fluidized bed for the combustion of a combustible material producing smoke, conduit means (17) for evacuating said smoke carrying along solid particles containing unburned matter, a device (3) for separating out said solid particles carried along by said smoke, and a circuit (41) for recycling to said fluidized bed said solid particles recovered in said separating device, said process comprising two alternating phases for supplying said fluidized bed with combustible material, viz., (1) a first phase of normal operation in which said fluidized bed is supplied with combustible material at an adjustable flow rate by supply means (21) so as to produce a predetermined temperature in said fluidized bed, and during which said solid particles recovered in said separating device (3) are accumulated in a reserve silo (4), said recycling circuit being closed, and (2) a second periodic recycling phase during which supply from said supply means (21) is halted and said recycling circuit (41) is opened, in order to recycle to said fluidized bed said solid particles accumulated in said reserve silo (4) during said first phase, recycling being so regulated that the combustion of said unburnt matter contained in said solid particles maintains the temperature of said fluidized bed at a desired level, said recycling circuit (41) being closed as soon as said temperature can no longer be maintained at said level, whereupon normal first phase operation resumes;

(3) an exothermic reaction being maintained alternatively by combustion of said combustible material in said first phase and by combustion of said unburnt matter in said second phase;

wherein said fluidized bed operates at a pressure higher than atmospheric pressure and is supplied with combustible matter occurring at the same pressure through a lock device, said supply proceeding from a single chamber forming a lock comprising an inlet and an outlet for material, each provided with an isolating valve respectively and pressurizing means and depressurizing means for said supply chamber, previously filled with fuel material, being alternately placed at the pressure of said combustion vessel during said second phase to be placed at atmospheric pressure and filled again with combustible matter.

* * * * *